US005309170A

United States Patent [19]

Takashi et al.

[11] Patent Number: 5,309,170

[45] Date of Patent: May 3, 1994

[54] HALF-TONE REPRESENTATION SYSTEM AND CONTROLLING APPARATUS THEREFOR

[75] Inventors: Terumi Takashi, Yokohama; Masahiro Jinushi; Kazuya Kouchiyama, both of Kamakura, all of Japan

[73] Assignees: Hitachi, Ltd., Tokyo; Hitachi Video Engineering, Inc., Yokohama, both of Japan

[21] Appl. No.: 514,591

[22] Filed: Apr. 26, 1990

[30] Foreign Application Priority Data

Apr. 28, 1989 [JP] Japan ..... 1-111791

[51] Int. Cl.[5] ..... G09G 1/28; G09G 3/00

[52] U.S. Cl. ..... 345/89; 345/88; 345/147

[58] Field of Search ..... 340/793, 703, 701; 345/88, 89

[56] References Cited

U.S. PATENT DOCUMENTS

| | | | |
|---|---|---|---|
| 4,763,120 | 8/1988 | Morrish et al. | 340/703 |
| 4,769,713 | 9/1988 | Yasui | 340/793 |
| 4,779,083 | 10/1988 | Ishii et al. | 340/784 |
| 4,788,536 | 11/1988 | Tanabe | 340/703 |
| 4,808,991 | 2/1989 | Tachuichi et al. | 340/793 |
| 4,825,203 | 4/1989 | Takeda et al. | 340/784 |
| 4,827,255 | 5/1989 | Ishii | 340/793 |

FOREIGN PATENT DOCUMENTS

| | | |
|---|---|---|
| 58-57192 | 4/1983 | Japan . |
| 0272792 | 11/1987 | Japan . |

OTHER PUBLICATIONS

Microcomputer Display, Graphics and Animation, Bruce A. Artwick, 1984.

*Primary Examiner*—Alvin E. Oberley
*Assistant Examiner*—Amare Mengistu
*Attorney, Agent, or Firm*—Antonelli, Terry, Stout & Kraus

[57] ABSTRACT

A half-tone color representation system suitable for use with a multi-color liquid crystal display panel, each display dot of which is constituted by three primary color pixels. More than eight different colors are represented with the three primary color pixels by providing a "half-tone" state of a pixel which is realized through successive ON-OFF controlling of the pixel. Flicker in the half-tone color representation of the display dot is reduced by causing the patterns or timings of successive ON-OFF controlling of the three primary color pixels to be different from one another.

11 Claims, 9 Drawing Sheets

HALF-TONE REPRESENTATION SYSTEM AND CONTROLLING APPARATUS THEREFOR

BACKGROUND OF THE INVENTION

1*a*.

This invention relates to a so-called frame-thinning type half-tone representation system, and more particularly to a half-tone representation system which is suitable for use with a multi-color liquid crystal display apparatus.

2*b*.

Japanese Laid-open Patent Application No. 58-57192 shows a half-tone representation system for a monochrone liquid crystal display apparatus with high-speed blinking of picture elements or pixels.

This prior art half-tone representation system is described below with reference to FIGS. 2, 3, 4 and 5.

FIG. 2 shows a block diagram of such a prior art half-tone representation system. In the drawing, an oscillator for generating a 8-dot reference clock or character clock signal 2 is indicated at 1; display address signal generator responsive to reference clock signal 2 for cyclically generating display addresses 4 for a single frame is indicated at 3; and display memories for storing 8-bit display data 61–64 are indicated at 51–54. Pieces of display information are stored in each of the memories 51–54 in one-to-one correspondence relation, and 8-bit display data 61–64 retrieved from each of memories 51–54 are in one-to-one correspondence relation in terms of bit unit. When all display data 61–64 are "LOW", "display OFF" is indicated; when all display data 61–64 are "HIGH", "display ON" is indicated; and otherwise, half-tone representation is indicated. A timing signal generator is indicated at 9; a frame signal is indicated at 10; a line signal is indicated at 11; a data shift signal is indicated at 12; and an AC drive signal is indicated at 13. The timing signal generator 9 generates the frame signal 10, the line signal 11, the data shift signal 12 and the AC drive signal 13 in response to the character clock signal 2. A half-tone controlling circuit is indicated at 14; a divide-by-three frame counter which uses the frame signal 10 as a clock signal for cyclically generating "0", "1" and "2", is indicated at 15; a frame count outputted by frame counter 15 is indicated at 16; a half-tone signal generator is indicated at 24; and a half-tone signal is indicated at 25. The half-tone signal generator 24 outputs a half-tone signal of "HIGH" when frame count 16 is, "0", and a half-tone signal of "LOW" when frame count 16 is "1" or "2". A display controlling circuit is indicated at 21 and 8-bit liquid crystal display data is indicated at 22. The display controlling circuit 21 functions to output as liquid crystal display data, a binary signal "HIGH" for normal representation or "display ON"; a binary signal "LOW" for "display OFF"; and is also controlled by half-tone signal 25 for half-tone representation. Liquid crystal display panel 231 composed of "m" dots x "n" lines is responsive to the liquid crystal display data 22 for providing visual representation of the data.

In FIG. 2, the display address generator circuit 3 functions to output addresses 4 to the display memories 51–54, thereby retrieving display information from memories 51–54. Each of the retrieved display information is of 8 bits, and is directed as display data to the display controlling circuit 21. The display controlling circuit 21 is responsive to the binary condition of each bit of display data 61–64 for outputting 8-bit liquid crystal display signal 22 to the liquid crystal display panel 231, specifically outputting display data signal of "HIGH" for normal display or "display ON"; display data signal of "LOW" for "display OFF"; of half-tone data which is "HIGH" in each one out of three frames in response to signal 25. The display address generator circuit 3 sequentially supplies display data 8 bits at a time to the liquid crystal panel 231 so as to sequentially provide display data of a frame. The liquid crystal display panel 231 functions to sequentially latch the liquid crystal display data 22 with data shift clock 12. After latching sufficient liquid crystal display data 22 to fill a full line of "m" dots, visual representation may be provided by means of line clock pulse 11, which pulse appears once for each line. This will be repeated "n" times to provide visual representation in a single frame. The beginning of each frame is indicated by the frame signal 10, and the liquid crystal display panel 231 is responsive to each appearance of "HIGH" frame signal 10 for beginning visual representation with the top line.

The above procedure is repeated to provide visual representation of all information stored in the memories 51–54.

FIG. 3 shows how liquid crystal panel 231 provides normal and half-tone representation of the liquid crystal display data 22 in the "0"th, 1st and 2nd frames.

Now, assume that information representing the letter "A" is stored in each of the display memories 51–54, and that information representing the letter "B" is stored only in the display memory 51. Then, the display controlling circuit 21 functions to output a binary signal of "HIGH" in each frame for the letter "A" and a half-tone signal 25 for the letter "B". Specifically, since frame counter 15 provides "0" in the "0"th frame, the half-tone signal 25 is "HIGH", allowing liquid crystal display panel 231 to provide visual representation of both letters "A" and "B" in the "0"th frame. The half-tone signal 25 is "LOW" in the 1st and 2nd frames, and then no visual representation of the letter "B" is caused in liquid crystal display panel 231 in these frames. Thus, the letter "B" will appear in only one frame out of three frames, and as a result the effective voltage applied to the liquid crystal panel 231 lowers compared with that for the letter "A". Thus, half-tone representation of the letter "B" is realized.

FIG. 4 shows a block diagram of a conventional liquid crystal display apparatus employing a multi-color liquid crystal display panel. Color liquid crystal display panel is indicated at 23; and red (R), green (G) and blue (B) liquid crystal display data are indicated at 221, 222 and 223. Same components as appear in FIG. 2 are indicated at same reference numerals in FIG. 4.

Display controlling circuit 21 is responsive to display data 61–64 for providing R-liquid crystal display data 221, G-liquid crystal display data 222 and B-liquid crystal display data 223, each of which will be "HIGH" for normal display or "display ON", "LOW" for "display OFF", and will be controlled by the half-tone signal 25 for half-tone representation. Color liquid crystal display panel 23 includes dots each made up by a R-pixel, G-pixel and B-pixel. The R-pixel provides a visual representation of R-liquid crystal display data 221; the G-pixel provides visual representation of G-liquid crystal display data 222; and the B-pixel provides a visual representation of B-liquid crystal display data 223. The operation of the system of FIG. 4 is essentially the same as that of FIG. 2, except for the following:

FIG. 5 show how color liquid crystal panel 23 provides half-tone representation of R-, G- and B-liquid crystal display data 221-223 in the "0"th frame, the 1st frame and the 2nd frame. In the drawing, visual half-tone representation of the letter "A" is provided for every R-, G- and B-pixel.

The above described prior art permits half-tone representation, but disadvantageously flickers are caused by ON-OFF control of every pixel in a selected frame or frames. The lightness characteristics of the filters used in a color display panel are not taken into consideration, and therefore it is difficult to provide desired half-tone representation.

SUMMARY OF THE INVENTION

One object of the present invention is to provide a half-tone representation system and half-tone representation controlling apparatus without causing flickering in the half-tone representation.

Another object of the present invention is to provide a half-tone representation system and half-tone representation controlling apparatus which are capable of providing half-tone representation in conformity with the lightness characteristics of the color filters used in a liquid crystal display panel.

According to one aspect of the present invention, there is provided a half-tone representation system in which each display dot is constituted by a set of N color pixels (N: an integer of two or more), each pixel being capable of being ON-OFF controlled to provide $^N$ different colors represented by a combination of ON and OFF states of the N color pixels, the half-tone representation system characterized in that colors other than said $2^N$ different colors are provided by successively ON-OFF controlling any one or more of said N color pixels, and that the patterns of successively ON-OFF controlling of the N color pixels are different in phase from one another.

In this system, the patterns themselves may be caused to be different instead of the phases of the patterns.

According to another aspect of the present invention, there is provided a half-tone representation system in which each display dot is constituted by a set of three primary color pixels, each pixel being capable of being ON-OFF controlled to provide eight different colors, the half-tone representation system being characterized in that colors other than said eight different colors are provided by a frame thinning operation of any one or more of said three primary color pixels, and that timings of the frame thinning of said three primary color pixels are different from one another.

In still another aspect of the present invention, there is provided a half-tone representation system in which each display dot is constituted by a set of three primary color pixels, each pixel being capable of being ON-OFF controlled to provide eight different colors, the half-tone representation system being characterized in that colors other than said eight different colors are provided by a frame thinning operation of any one or more of said three primary color pixels, and that the frame thinning operation is performed such that the frame thinnings of said three primary color pixels never occur at time.

In still further aspect of the present invention, there is provided a half-tone representation system in which each display dot is constituted by a set of three liquid crystal pixels with three primary color filters attached thereon, each pixel being capable of being ON-OFF controlled to provide eight different colors, the half-tone representation system being characterized in that colors other than said eight different colors are provided by a frame thinning operation of any one or more of said three primary color pixels, and that rates of the frame thinning of said three primary color pixels are different from one another.

The present invention also provides a half-tone representation controlling apparatus adapted to effect a control based on display data of a color display panel which has display dots each being constituted by a set of N color pixels, each of the pixels being capable of being ON-OFF controlled, the half-tone representation controlling apparatus comprising: a frame counter for counting the number of display frames of the color display panel; N half-tone signal generators each for producing an "ON" signal during a time when the count of said frame counter is a predetermined value or values which are different for each of the N half-tone signal generators; and a control circuit responsive to the display data which represents a half-tone color for outputting selected or all of the half-tone signals to said color display panel in place of a part or all of said display data.

In this half-tone representation controlling apparatus, each of said N half-tone signal generators may have a separate frame counter assigned thereto. In this case, maximum counts and said predetermined values of the separate frame counters are preferably set such that the proportion of lightnesses of said N color pixels all in "ON" states are equal to that of the lightness of said N color pixels all in "half-tone" states.

The present invention further provides a color display panel, comprising: a multitude of display dots disposed on the color display panel, each of the display dots being constituted by a set of N color pixels each capable of being ON-OFF controlled; and one of the half-tone representation controlling apparatuses, the apparatus being built in the color display panel.

A half-tone display system according to the present invention employs the intermittent ON-OFF controlling of a selected one or ones or all of the pixels which make up each display dot. The minimum time unit in which the intermittent ON-OFF controlling of pixels can be performed, may be practically a "frame period", that is, a length of time for which a single frame is provided, and OFF-controlling on the basis of a frame period is referred to as "frame-thinning". However, the time unit on the basis of which the intermittent ON-OFF controlling is performed on pixels may be other than the frame period.

The inventors found that the cause for flickering is present in the coincidence between the ON-OFF patterns and the timings for pixels. In an attempt to reduce the flickering in half-tone representation, the ON-OFF pattern for performing the ON-OFF control on each color pixel is changed in phase, or the ON-OFF pattern itself is changed so that the ON-OFF timing on each of the color pixels together constituting each dot is different from the ON-OFF timing on other pixels. This avoids coincidences of the ON-OFF timings on the pixels which make up a dot, thus reducing the flickering.

In a case using a multi-color display panel whose pixels have different color filters associated therewith, the frame thinning rate is changed with each different color, thereby compensating for the difference between the lightness characteristics of different color filters.

Other objects and advantages of the present invention will be understood from the following description of half-tone representation system and half-tone representation controlling apparatus according to preferred embodiments of the present invention.

DESCRIPTION OF PREFERRED EMBODIMENT

Figure 1:
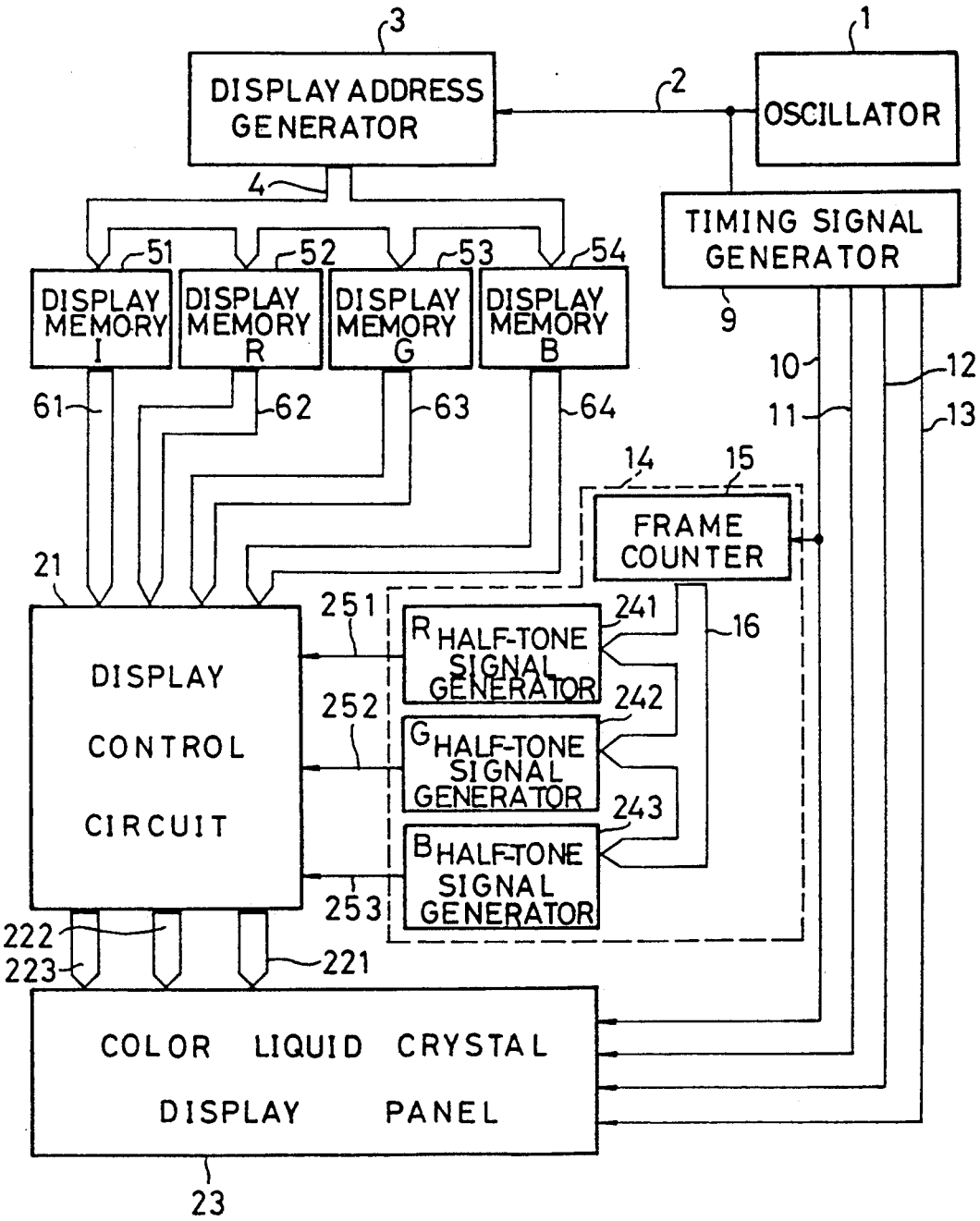
FIG. 1 is a block diagram of a display apparatus using a liquid crystal display controlling circuit according to one embodiment of the present invention.
Figure 2:
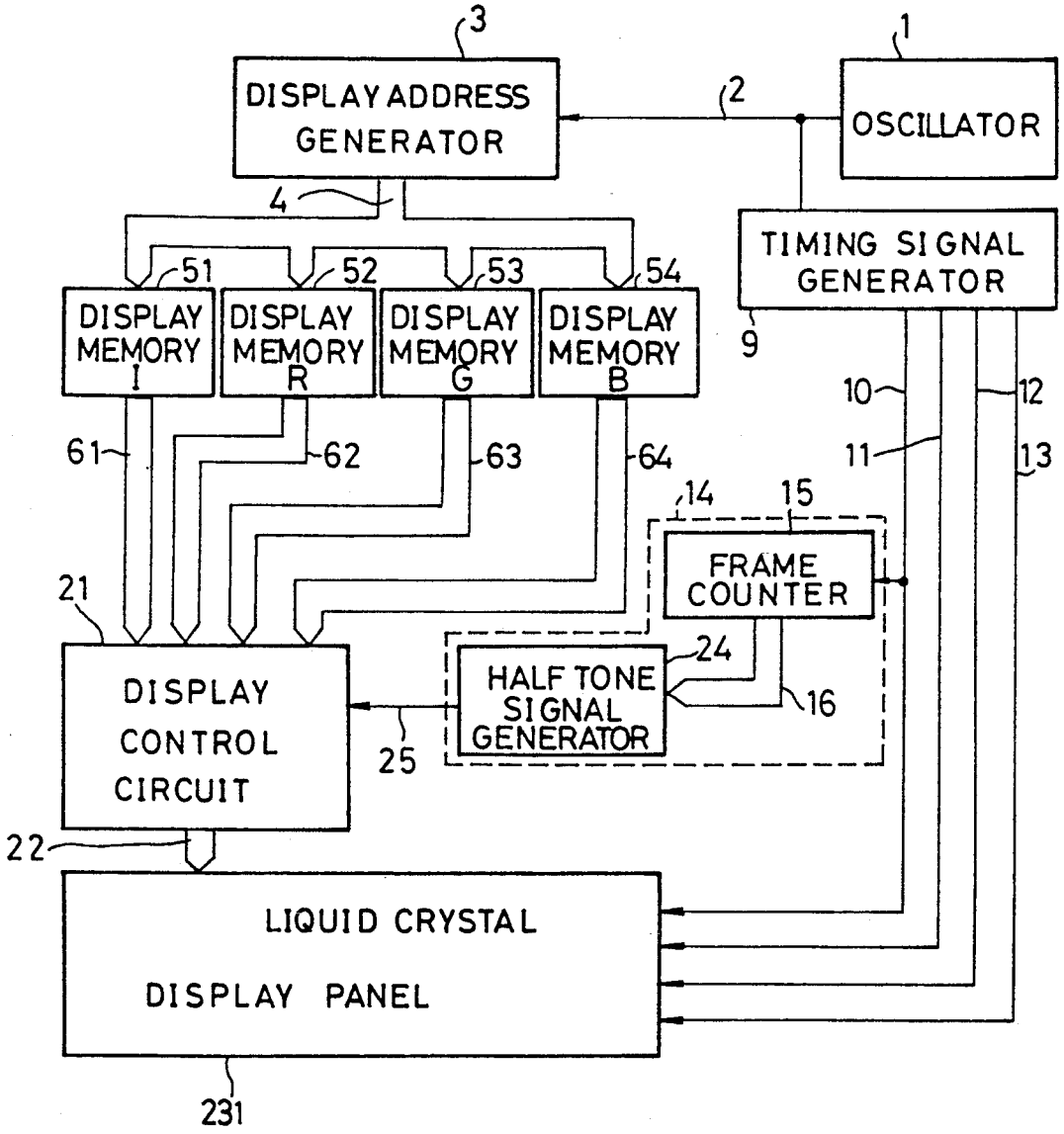
FIG. 2 (PRIOR ART)
FIGS. 2 and 4 are block diagrams of conventional liquid crystal display controlling circuits.
Figure 3:
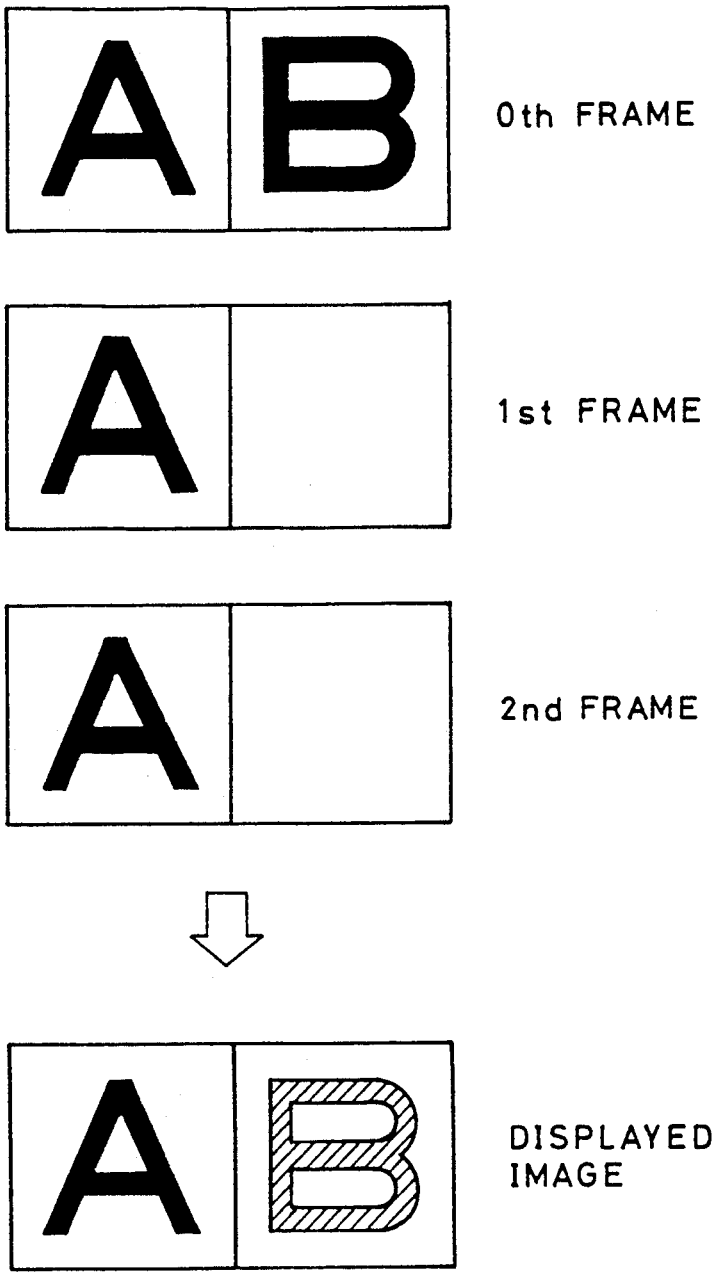
FIG. 3 (PRIOR ART)
FIGS. 3 and 5 show how liquid crystal display data are related with subsequent frames to provide normal and half-tone representation in a liquid crystal display panel.
Figure 4:
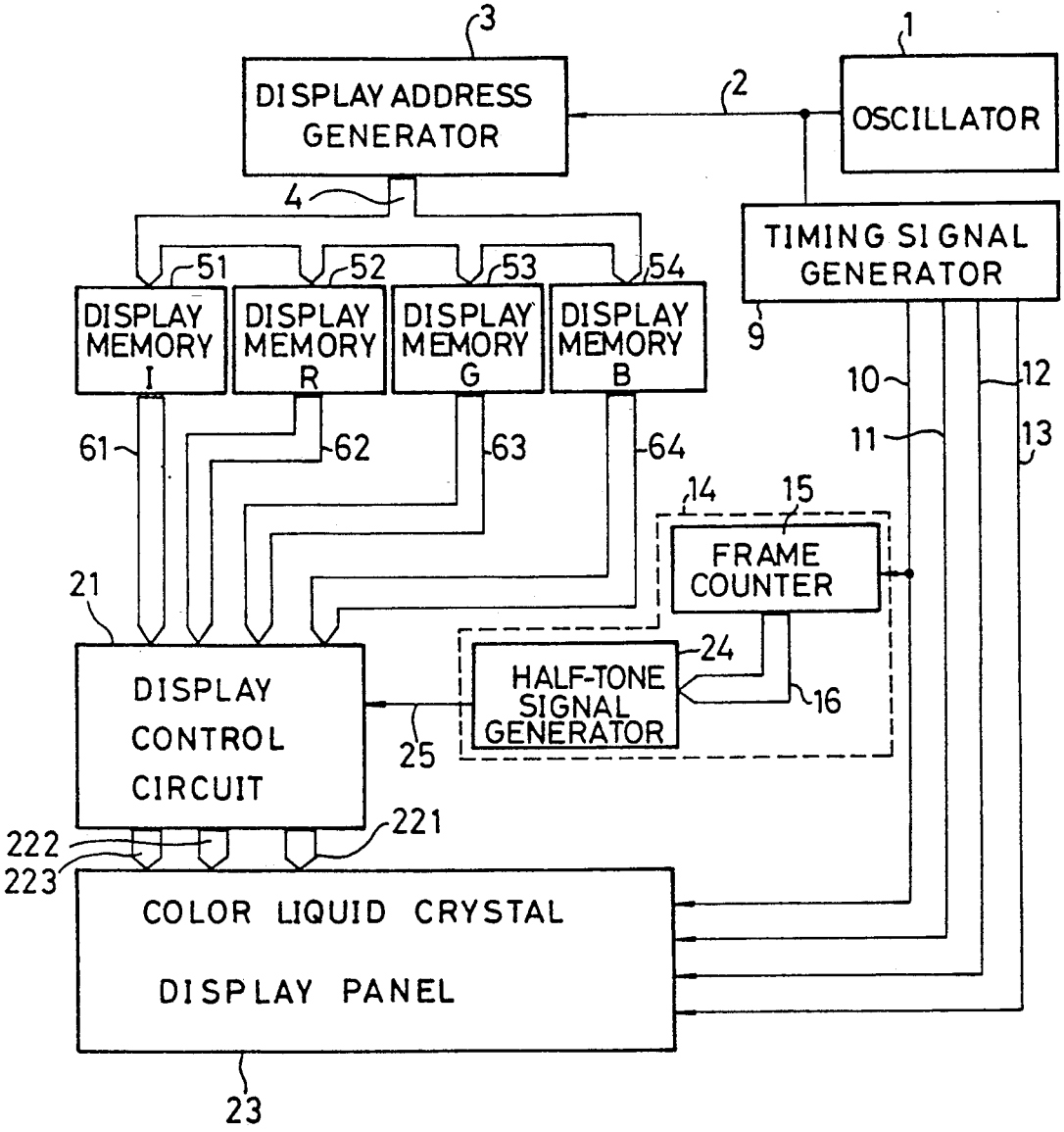
FIG. 4 (PRIOR ART)
Figure 5:
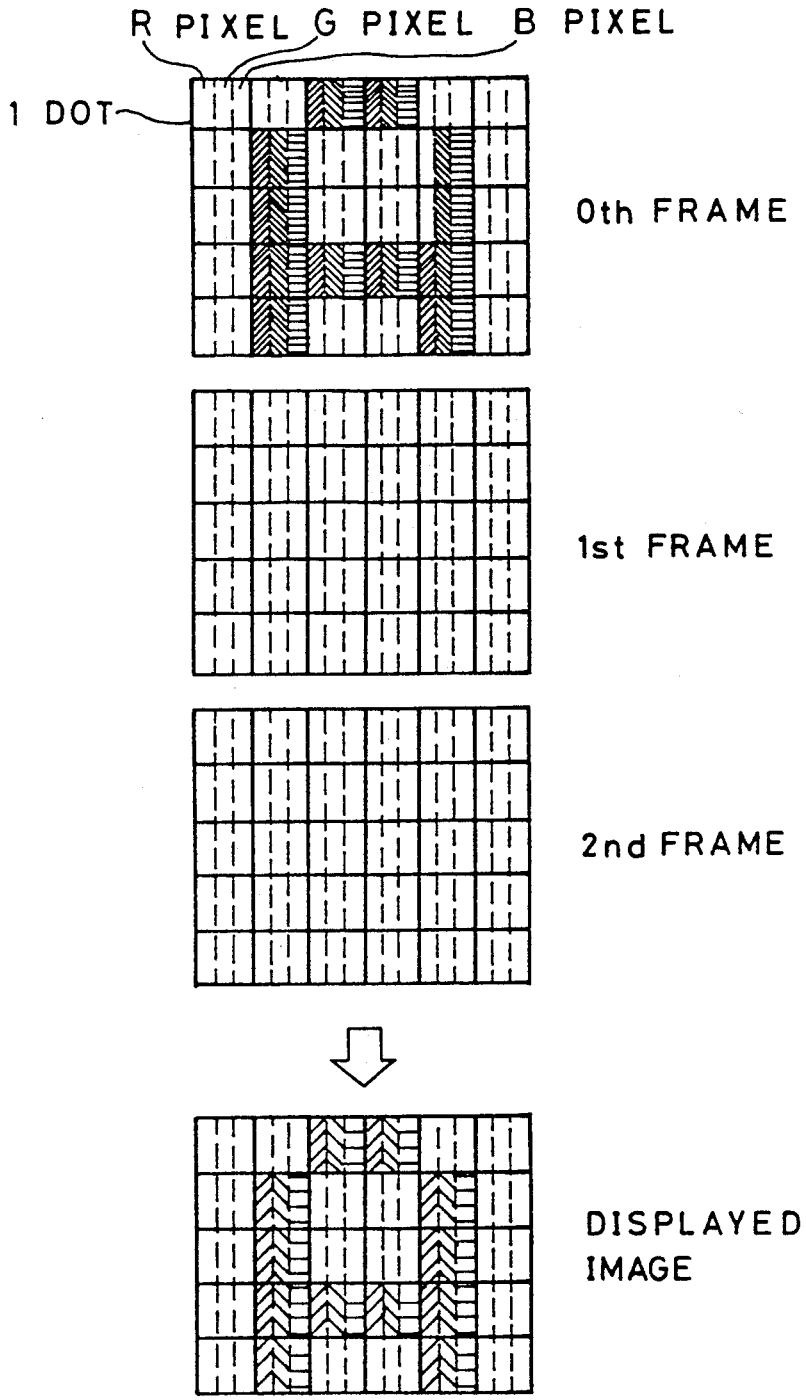
FIG. 5 (PRIOR ART)

FIG. 1 shows a liquid crystal display controlling apparatus according to one embodiment of the present invention. Half-tone signal generators for red, green and blue are indicated at 241, 242 and 243 respectively, and half-tone signals for red, green and blue are indicated at 251, 252 and 253, respectively. In FIG. 1 the components appearing in FIG. 4 are indicated by the same reference numerals.

"R"-half-tone signal generator 241 will provide an "R"-half-tone signal 251 of "HIGH" at its output terminal when frame count 16 is "0", and otherwise, it will provide an "R"-half-tone signal 251 of "LOW" at its output terminal. "G"-half-tone signal generator 242 will provide a "G"-half-tone signal 252 of "HIGH" at its output terminal when frame count 16 is "2" and otherwise, it will provide a "G"-half-tone signal 252 of "LOW" at its output terminal. And, "B"-half-tone signal generator 243 will provide a "B"-half-tone signal 253 of "HIGH" at its output terminal when frame count 16 is "1", and otherwise, it will provide a "B"-half-tone signal 253 of "LOW" at its output terminal. Display controlling circuit 21 is responsive to information data 61–64 for controlling liquid crystal display data 221–223 of R, G and B as shown in Table 1.

TABLE 1

| | conditions of display data 61–64 | | | | conditions of liquid crystal display data 221–223 | | |
|---|---|---|---|---|---|---|---|
| # | 61(I) | 62(R) | 63(G) | 64(B) | 221(R) | 222(G) | 223(B) |
| 0 | L | L | L | L | L | L | L |
| 1 | L | L | L | H | L | L | H |
| 2 | L | L | H | L | L | H | L |
| 3 | L | L | H | H | L | H | H |
| 4 | L | H | L | L | H | L | L |
| 5 | L | H | L | H | H | L | H |
| 6 | L | H | H | L | H | H | L |
| 7 | L | H | H | H | H | H | H |
| 8 | H | L | L | L | H.T. | H.T. | H.T. |
| 9 | H | L | L | H | H.T. | H.T. | H |

TABLE 1-continued

| | conditions of display data 61–64 | | | | conditions of liquid crystal display data 221–223 | | |
|---|---|---|---|---|---|---|---|
| # | 61(I) | 62(R) | 63(G) | 64(B) | 221(R) | 222(G) | 223(B) |
| 10 | H | L | H | L | H.T. | H | H.T. |
| 11 | H | L | H | H | H.T. | H | H |
| 12 | H | H | L | L | H | H.T. | H.T. |
| 13 | H | H | L | H | H | H.T. | H |
| 14 | H | H | H | L | H | H | H.T. |
| 15 | H | H | H | H | H | H | H |

H: HIGH
L: LOW
H.T.: half-tone

Assume that display data 61–64 are in condition #8 in Table 1. Then, display controlling circuit 21 will output R-half-tone signal 251, which will be "HIGH" when the frame count is "0", as the R-liquid crystal display data 221; it will output G-half-tone signal 252, which will be "HIGH" when the frame count is "2", as the G-liquid crystal display data 222; and it will output B-half-tone signal 253, which will be "HIGH" when the frame count is "1", as the B-liquid crystal display data 223.

Figure 6:
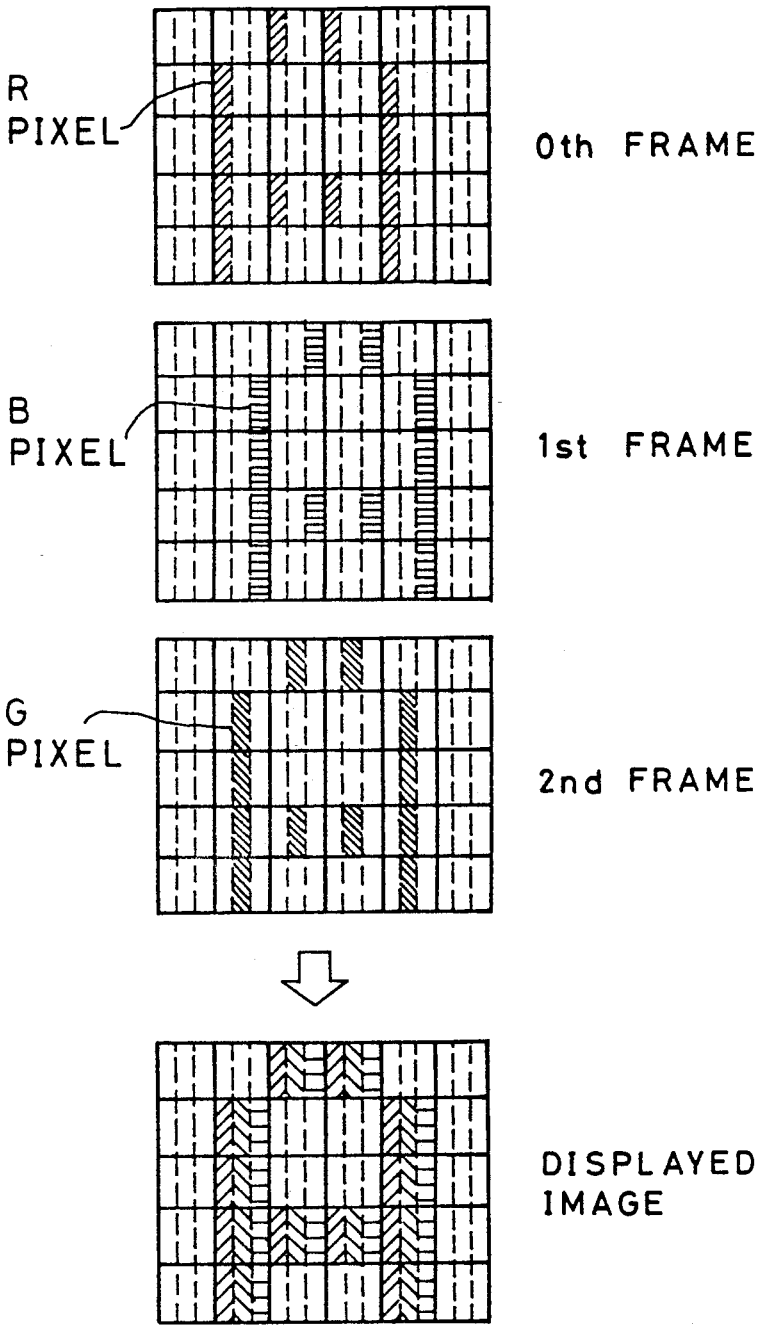
FIG. 6 shows how liquid crystal display data are related with subsequent frames to provide half-tone representation in a liquid crystal display panel according to the present invention.

FIG. 6 shows how color liquid crystal display panel 23 responds to liquid crystal display data 221–223 in the "0"th frame, 1st frame and 2nd frame.

Now, assume that display memory 51 contains information representing the letter "A" and that the other display memories 52–54 contain nothing. In this case the binary conditions of display data 61–64 for the dots forming the letter "A" correspond to #8in Table 1. Referring to FIG. 6, the frame count 16 is "0" at the "0"th frame, and then only R-half-tone signal 251 is "HIGH", and is directed to liquid crystal display panel 23 via display controlling circuit 21, thus activating only R-pixels in the liquid crystal display panel 23. The frame count 16 is "1" in the 1st frame, and then only B-half-tone signal 253 is "HIGH", activating only B-pixels in the liquid crystal display panel 23. Likewise, the frame count 16 is "2" in the 2nd frame, and then only G-half-tone signal 252 is "HIGH", activating only G-pixels in the liquid crystal display panel 23. Thus, R-, G- and B-pixels will be selectively activated or turned on in each frame, and therefore no flickering will be caused.

In this particular embodiment, each of R-, G- and B-pixels is capable of being activated or turned on during one frame out of three frames. The present invention, however, should not be limited to this particular example. A divide-by-N (N72) counter may be used, and accordingly R-, G- and B-half-tone signal generators may be modified so that activation of selected elements is effected during one frame out of N frames. Also, it is possible that non-activation of a selected color picture element is effected during one frame out of N frames. Further, pixels can be turned on or off during M frames (M=2, 3, . . . ) out of N (7M) frames.

Figure 7:
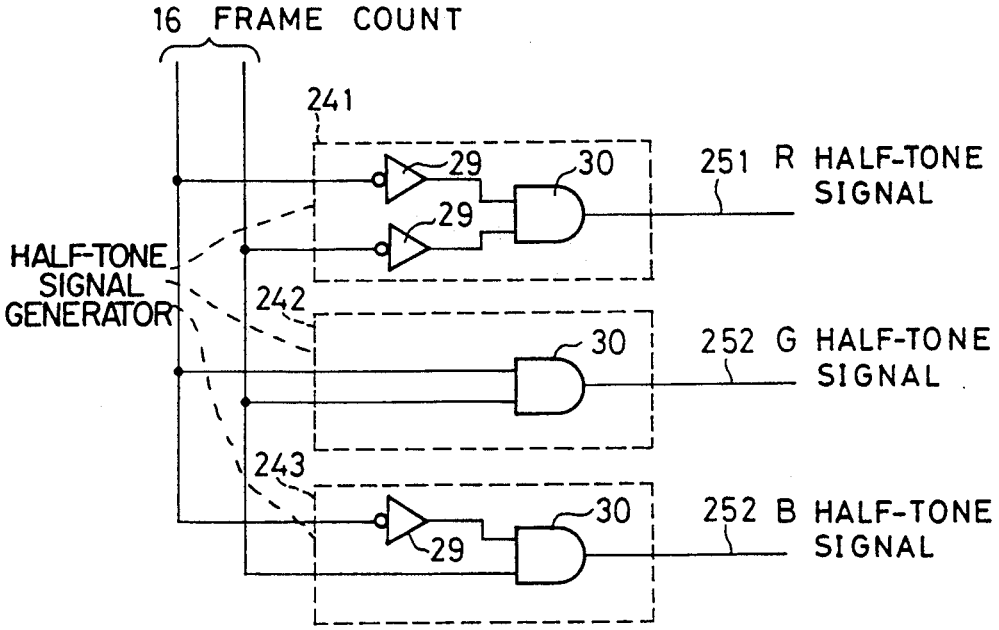
FIG. 7 is a wiring diagram of half-tone controlling circuit according to a first embodiment of the present invention.

The activation or turning-on of one selected color picture element in one out of three frames can be attained by a decoder circuit configuration of FIG. 7, which is composed of AND circuits 30 and inverters 29. The decoder may contain additional OR circuits. Also, this can be attained by a pattern memory which is designed to be addressed by the frame count 16. In FIG. 7, R-half-tone signal generator 241 will provide a signal "HIGH" at its output terminal when the frame count 16 is "0"; G-half-tone signal generator 242 will provide a signal "HIGH" at its output terminal when the frame count 16 is "2"; and B-half-tone signal generator 243 will provide a signal "HIGH" at its output terminal when the frame count 16 is "1". These signals appearing at the output terminals of the signal generators 241, 242 and 243 are R-, G- and B- half-tone signals 251, 252 and 253. Timing according to which R-, G- and B-pixels are intermittently activated, can be controlled by changing the circuit configuration of the decoder or by changing patterns to be stored in the pattern memory.

Although the mode of operation in the display controlling circuit 21 was given in Table 1, it is to be noted that the present invention is not limited to the particular mode of operation.

Figure 8:
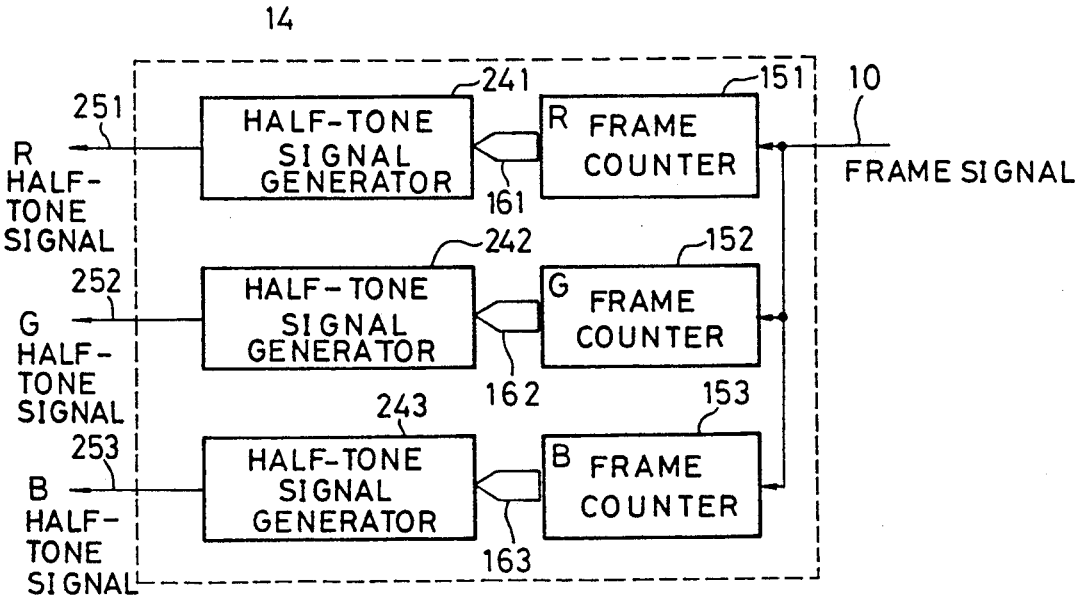
FIG. 8 is a block diagram of a half-tone controlling circuit according to a second embodiment of the present invention.

FIG. 8 shows half-tone controlling circuit 14 according to the second embodiment of the present invention.

In FIG. 8 R-frame counter 151 is a divide-by-x counter (x is an integer of two or more) which is responsive to the frame signal 10 for counting frames. The signal representing R-frame count 161 is directed to R-half-tone signal generator 241. G-frame counter 152 is a divide-by-y (y is an integer of two or more, including x) counter which is responsive to the frame signal 10 for counting frames. The signal representing G-frame count 162 is directed to G-half-tone signal generator 242. Likewise, B-frame counter 153 is a divide-by-z (z is an integer of two or more, including x and y) counter which is responsive to the frame signal 10 for counting frames. The signal representing B-frame count 163 is directed to B-half-tone signal generator 243. If R-frame counter 151, G-frame counter 152 and B-frame counter 153 are the divide-by-N counters and if R-half-tone signal generator 241, G-half-tone signal generator 242 and B-half-tone signal generator 243 function in the same way as in the first embodiment, then the half-tone controlling circuit 14 of FIG. 8 functions in the same way as that of FIG. 1.

Figure 9:
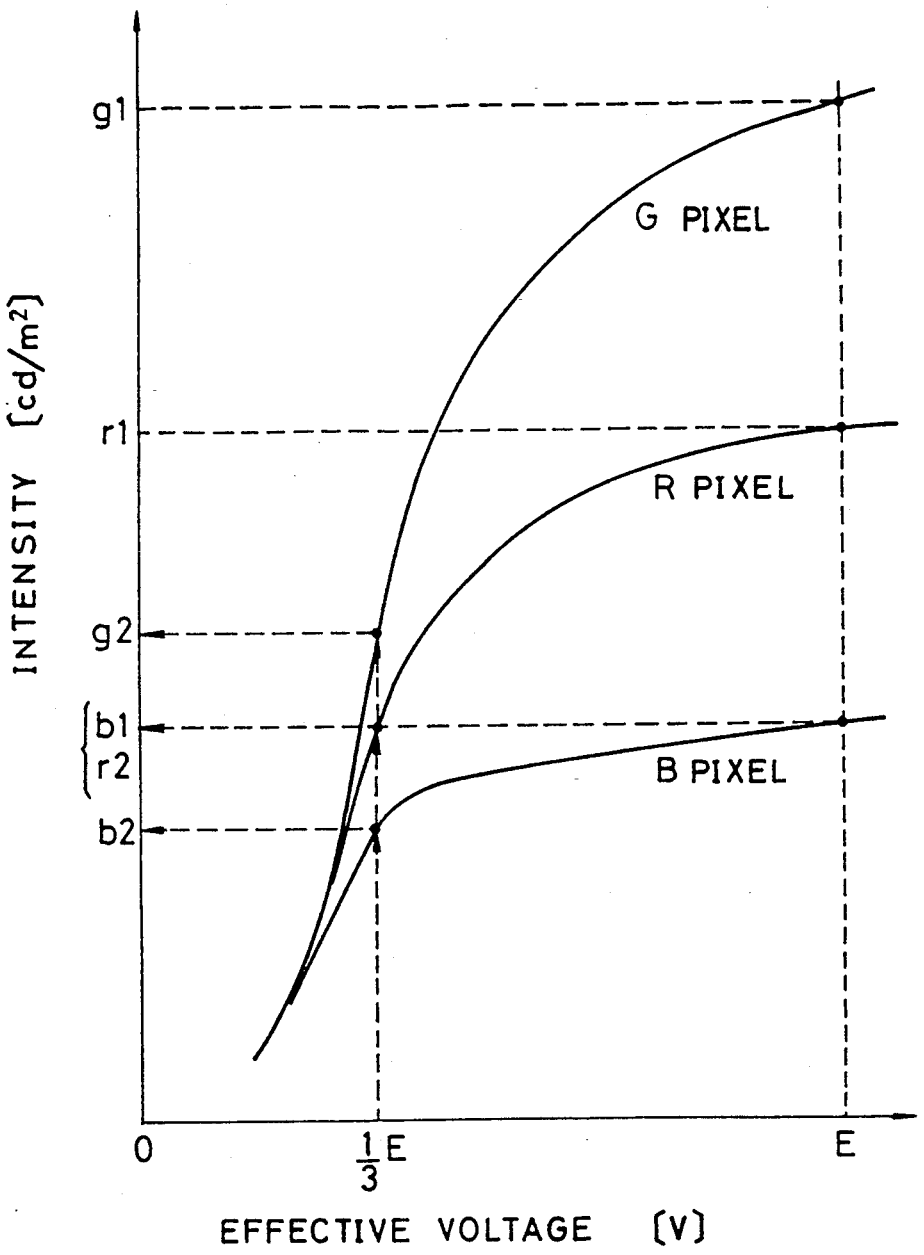
FIGS. 9 and 10 are graphs representing the effective voltage-to-lightness or intensity characteristics of each of R-, G- and B-pixels.
Figure 10:
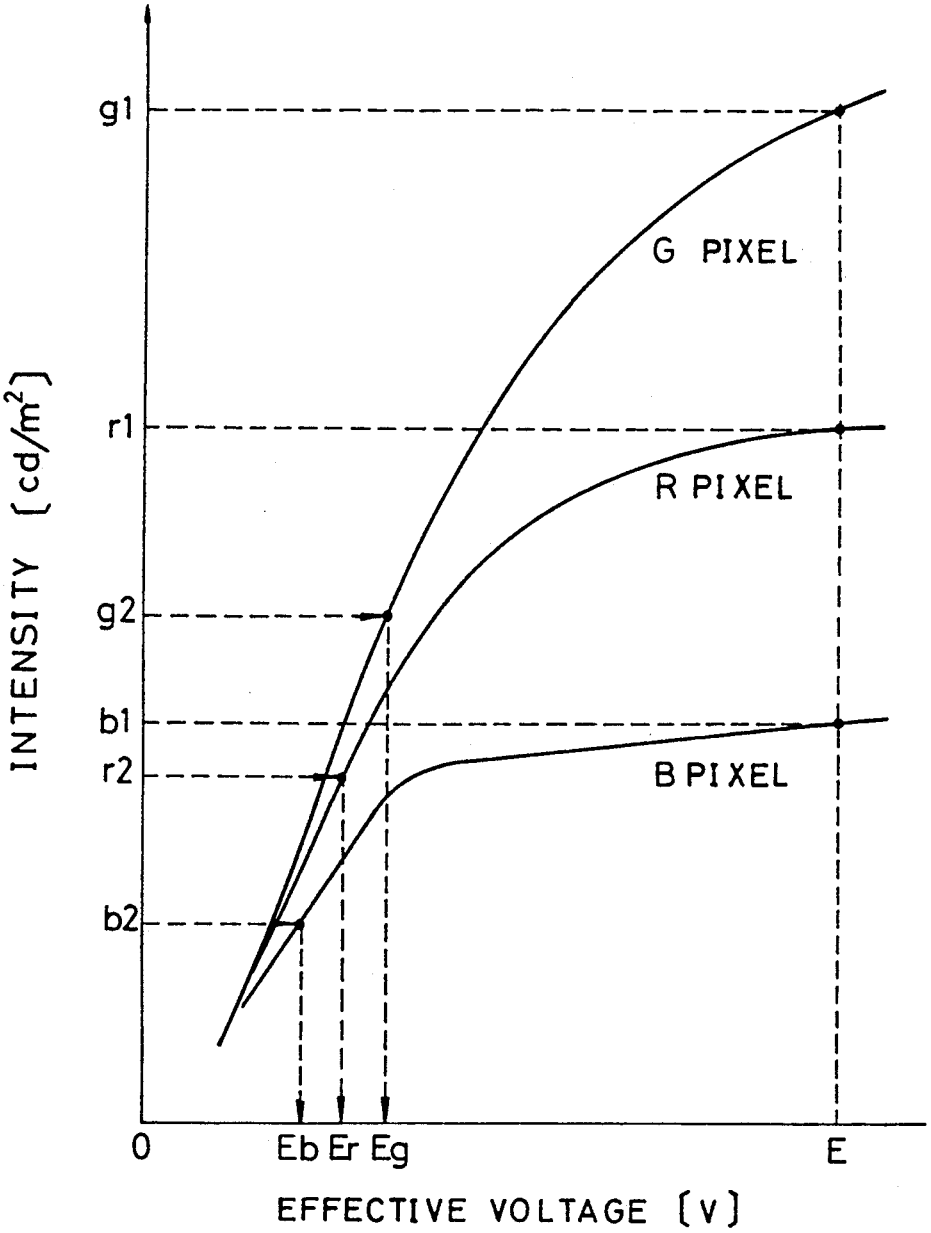

FIGS. 9 and 10 are graphs representing the relationship between effective voltage E(volts) and the lightness or intensity each of R-, G- and B-pixels.

Assume in FIG. 9 that an effective voltage E(volts) provides $r_1$(cd/m$^2$) for R-pixels; $g_1$(cd/m$^2$for G-pixels and $b_1$(cd/m$^2$) for B-pixels and that the effective voltage is E(volts) at which R-, G- and B-pixels are all in condition for "display ON". Also assume that R-, G- and B-frame counters 151, 152 and 153 are divide-by-three counters, and that R-, G- and B-half-tone signal generators 241, 242 and 243 provide "display ON" during one frame out of three frames. On simultaneous half-tone representation of R-, G- and B-pixels the effective voltage will be about $\frac{1}{3}$ E(volts). Then, the intensity of R-pixel is $r_2$(cd/m$^2$); the intensity of G-pixel is $g_2$(cd/m$^2$); and the intensity of B-pixel is $b_2$(cd/m$^2$). The intensity of each of R-, G- and B-pixels will not linearly vary with the effective voltage, and therefore, $$r_1:g_1:b_1 \neq r_2:g_2:b_2.$$

When R-, G- and B-pixels are all in condition for "display ON", white color representation is provided, but when R-, G- and B-pixels are all in condition for half-tone representation, grey (i.e. color represented by lowering the intensity of "white") cannot be provided because of the above-noted non-linearity.

In an attempt to reduce this adverse effect, first, effective voltages for R-, G- and B-pixels to hold the equation $r_1:g_1:b_1=r:g_2:b_2$ are determined, and then R-, G- and B-frame counters 151, 152 and 153 in FIG. 8 and R-, G- and B-half-tone signal generators 241, 242 and 243 are modified in structure to permit application of so determined effective voltages to R-, G- and B-pixels, thereby permitting grey representation with simultaneous medium tone representations of R-, G- and B-pixels.

As seen from the above, in this particular embodiment half-tone control can be performed on each of R-, G- and B-pixels on the basis of their effective voltage-to-intensity characteristics, thus providing natural medium color representation. In place of R-frame counter 151 plus R-half-tone signal generator 241; G-frame counter 152 plus G-half-tone signal generator 242 or B-frame counter 153 plus B-half-tone signal generator 243, use may be made of a corresponding frame counter plus a pattern memory which is designed to be addressed by instantaneous count of the frame signal 10. Advantageously, this arrangement can be easily adjusted to meet the situation in which frame-thinning timing must be changed with the change of lightness characteristics which is caused by the change of frame frequency.

In this particular embodiment the half-tone display control is carried out in conformity with the lightness characteristics of each of R-, G- and B-pixels. Conversely, the lightness characteristics of each of R-, G- and B-pixels may be controlled in accordance with the half-tone display control. To attain this, the characteristics of color filters used in the liquid control display may be made to vary.

"n" kinds of half-tone display circuits for R-, G-and B-pixels (for example, two kinds of $\frac{1}{3}$ "display ON" and $\frac{1}{3}$ "display OFF") are prepared, and then "x (=n+2)" kinds (four kinds for the same example) of color representation are permitted, including all frames being in condition for "display ON" and all frames being in condition for "display OFF". In this case, each of R-, G- and B-pixels can have "x" (four) kinds of lightness, and therefore the possible maximum of color representations attained by combining R-, G- and B-pixels of different lightness will be equal to $x^3$ (64 for the same example).

A liquid crystal display panel itself can be equipped with such half-tone producing circuit to provide a multi-color liquid crystal display panel. That is, a half-tone producing circuit or controlling apparatus is built in the color liquid crystal display panel. Digital or analog interface may be equally used for the data interface. For instance, in case of the use of analog interface, a digital-to-analog converter may be used to convert digital data from the display memories to R-, G-and B-analog signals before outputting to the liquid crystal panel. The analog-to-digital converters associated with the color liquid crystal display panel convert each of R-, G- and B-analog signals to respective digital signals, which are used to operate the half-tone producing circuit for visual multi-color representation.

As described above, each dot may be made up by N pixels, a for example, a R-pixel, G-pixel and a B-pixel, and each different pixel is activated at a selected frame, and therefore little or no flickering is caused.

R-pixel, G-pixel and B-pixel are activated by selected effective voltages, each determined to be appropriate for the effective voltage-to-lightness characteristics of each pixel.

The half-tone controlling circuit can be made simple by using the filters whose lightness characters are determined on the basis of the frame-thinning rate, and accordingly the cost of the half-tone controlling circuit can be reduced.

Liquid crystal display panels may be equipped with half-tone controlling circuits, each of which is designed to be most appropriate for the characteristics of the associated display panel. This makes it unnecessary to modify the half-tone controlling circuit of the system to meet the characteristics of a new display panel.

What is claimed is:

1. A half-tone representation system for displaying data on a display in which each display dot is constituted by a set of N color pixels, where N is an integer of three or more, each pixel capable of being ON-OFF controlled to provide a predetermined number of different colors depending on the combination of ON and OFF states of the N color pixels, the half-tone representation system comprising means for controlling said display to provide an increased number with respect to the predetermined number of different colors by successively ON-OFF controlling any one or more of said N color pixels in a half-tone state according to a predetermined repetitive ON-OFF pattern in successive frames, and means for causing, when at least two of the N color pixels are in the half-tone state, the predetermined repetitive ON-OFF patterns for the at least two or the N color pixels to be different in phase from one another.

2. A half-tone representation controlling apparatus for controlling the display of display data on a color display panel which has display dots each being constituted by a set of N color pixels, where N is an integer of three or more, each of the pixels being capable of being ON-OFF controlled, the half-tone representation controlling apparatus comprising:

a frame counter for counting the number of display frames of the color display panel;

N half-tone signal generators each for producing an "ON" signal during a time when the count of said frame counter is a predetermined value or values which are different for each of the N half-tone signal generators; and a control circuit responsive to the display data which represents a half-tone color for outputting selected part or all of the half-tone signals to said color display panel in place of a part or all of said display data.

3. A half-tone representation controlling apparatus according to claim 2, wherein each of said N half-tone signal generators has a separate frame counter connected thereto.

4. A half-tone representation controlling apparatus according to claim 3, wherein maximum counts and said predetermined values of the separate frame counters are set such that a proportion of lightnesses of said N color pixels all in "ON" states are equal to that of lightnesses of said N color pixels all in "half-tone" states.

5. A system having color display panel for display data in colors, comprising:

a multitude of display dots disposed on the color display panel, each of the display dots being constituted by a set of N color pixels each capable of being ON-OFF controlled, where N is an integer of three or more;

a half-tone representation controlling apparatus built in the color display panel, and including:

a frame counter for counting the number of display frames of the color display panel;

N half-tone signal generators each of producing an "ON" signal during a time when the count of said frame counter is a predetermined value or values which are different from each of the N half-tone signal generators; and a control circuit responsive to the display data which represents a half-tone color for outputting selected part of all of the half-tone signals to said color display panel in place of a part or all of said display data.

6. A system according to claim 5, wherein each of said N half-tone signal generators has a separate frame counter connected thereto.

7. A system according to claim 5, wherein maximum counts and said predetermined values of the separate frame counters are set such that a proportion of lightness of said N color pixels all in "ON" states are equal to that of lightness of said N color pixels all in "half-tone" states.

8. A half-tone representation system for displaying data on a display in which each display dot is constituted by a set of N color pixels, where N is an integer of three or more, each pixel capable of being ON-OFF controlled to provide a predetermined number of different colors depending on the combination of ON and OFF states of the N color pixels, the half-tone representation system comprising means for controlling said display to provide an increased number with respect to the predetermined number of different colors by successively ON-OFF controlling any one or more of said N color pixels in a half-tone state in successive frames, and means for inhibiting, when at least two of the N color pixels are in the half-tone state, the at least two of the N color pixels from being in the ON state simultaneously.

9. A half-tone representation system for displaying data on a display in which each display dot is constituted by a set of N color pixels, where N is an integer of three or more, each pixel capable of being ON-OFF controlled in response to N bits of display data for displaying colors, the half tone representation system comprising:

means for inputting an (N+1)-th bit of display data;

means for generating N half-tone signals, each of the N half-tone signals having a predetermined repetitive ON-OFF pattern including a combination of ON and OFF states, each of the N half-tone signals being different in phase from one another; and means for replacing one or more of the N bits of display data which are in an OFF state by a respective half-tone signal in dependence upon a state of the (N+1)-th bit of display data.

10. A half-tone representation system for displaying data on a display in which each display dot is constituted by a set of N color pixels, where N is an integer of three or more, each pixel capable of being ON-OFF controlled to provide a predetermined number of different colors depending on the combination of ON and OFF states of the N color pixels, the half-tone representation system comprising means for controlling said display to provide an increased number with respect to the predetermined number of different colors by a frame thinning operation of any one or more of said N color pixels in successive frames so that when two or more of the N color pixels under the frame thinning operation are controlled, the two or more of the N color pixels do not change to an ON state in the same frame.

11. A system according to claim 10, wherein the means for controlling controls the rates of the frame thinning of the N color pixels to be different from one another.

* * * * *